US009279569B2

(12) United States Patent
Lamonato et al.

(10) Patent No.: US 9,279,569 B2
(45) Date of Patent: Mar. 8, 2016

(54) LIGHTING DEVICE

(71) Applicant: OSRAM GmbH, Munich (DE)

(72) Inventors: Marco Lamonato, Crocetta del Montello/Treviso (IT); Dina Pasqualini, Udine (IT); Alessandro Scordino, Dolo/Venezia (IT); Alberto Zanotto, Padova (IT)

(73) Assignee: Osram GmbH, Munich (DE)

( * ) Notice: Subject to any disclaimer, the term of this patent is extended or adjusted under 35 U.S.C. 154(b) by 212 days.

(21) Appl. No.: 14/049,258

(22) Filed: Oct. 9, 2013

(65) Prior Publication Data

US 2014/0104856 A1 Apr. 17, 2014

(30) Foreign Application Priority Data

Oct. 11, 2012 (IT) ..... TO2012A0888

(51) Int. Cl.

| | |
|---|---|
| ***F21V 19/00*** | (2006.01) |
| ***F21V 15/01*** | (2006.01) |
| ***F21V 31/00*** | (2006.01) |
| *F21Y 105/00* | (2006.01) |
| *F21Y 101/02* | (2006.01) |

(52) U.S. Cl.

CPC ..... *F21V 15/01* (2013.01); *F21V 19/0035* (2013.01); *F21V 19/0055* (2013.01); *F21V 31/005* (2013.01); *F21V 19/0015* (2013.01); *F21Y 2101/02* (2013.01); *F21Y 2105/001* (2013.01)

(58) Field of Classification Search

CPC ..... F21V 19/0015; F21V 19/002; F21V 19/0025; F21V 19/003; F21V 19/0035; F21V 19/004; F21V 19/0045; F21V 19/0055; F21V 23/007; F21V 23/008; F21V 23/009; G02F 1/133308; G02F 1/133608; G02F 2001/133317; G02F 2001/133314; G02F 2001/13332

See application file for complete search history.

(56) References Cited

U.S. PATENT DOCUMENTS

| | | | | |
|---|---|---|---|---|
| 7,918,596 | B2 * | 4/2011 | Frank et al. | 362/542 |
| 8,177,397 | B1 * | 5/2012 | Knoble et al. | 362/373 |
| 2009/0052199 | A1 * | 2/2009 | Bolander et al. | 362/509 |
| 2009/0267525 | A1 | 10/2009 | Zheng et al. | |
| 2009/0290345 | A1 | 11/2009 | Shaner | |
| 2010/0079991 | A1 * | 4/2010 | Zhang | 362/235 |
| 2012/0188766 | A1 | 7/2012 | Lu et al. | |
| 2012/0268929 | A1 * | 10/2012 | Chung et al. | 362/231 |

FOREIGN PATENT DOCUMENTS

| | | | |
|---|---|---|---|
| DE | 202006016336 | U1 | 2/2007 |
| DE | 202011106387 | U1 | 12/2011 |
| WO | 2010022625 | A1 | 3/2010 |

* cited by examiner

*Primary Examiner* — Julie Bannan

(74) *Attorney, Agent, or Firm* — Viering, Jentschura & Partner mbB

(57) ABSTRACT

A lighting device for mounting on a mounting surface may include: a planar solid state lighting module having a light emitting region and peripheral holes for fixing members to the mounting surface to extend therethrough, a peripheral gasket extending along the periphery of the lighting module; the gasket having, at the holes of the lighting module, ear-like extensions having a perforation therein, said ear-like extensions extending inwardly of the gasket to align the perforations therein with the holes in the lighting module, a housing which frames the lighting device with the gasket applied onto the lighting module. The housing has apertures aligned with the holes in the lighting module and the perforations in the ear-like extensions of the gasket, as well as a window to expose the light emitting region of the lighting module, with a light permeable screen which sealingly closes said window.

7 Claims, 3 Drawing Sheets

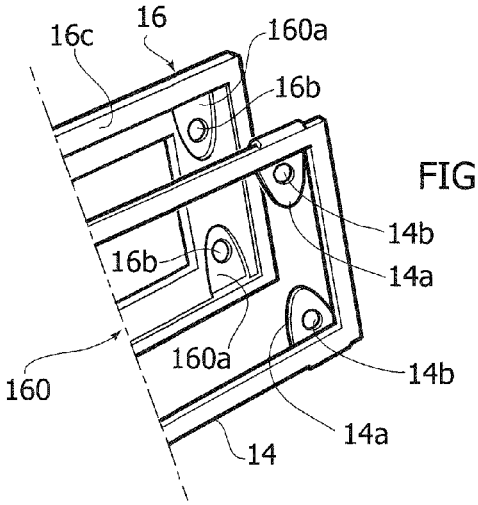
FIG. 5
FIG. 6
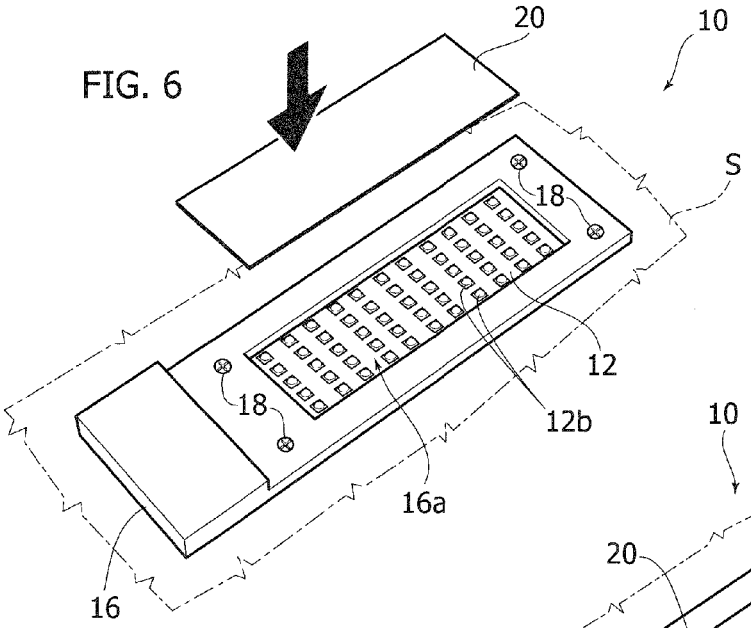
FIG. 7
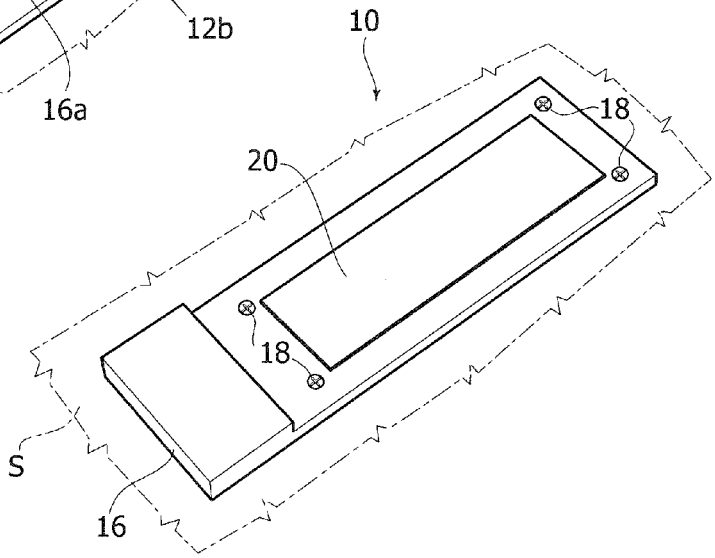

LIGHTING DEVICE

RELATED APPLICATIONS

The present application claims priority from Italian application No.: TO2012A000888 filed on Oct. 11, 2012.

TECHNICAL FIELD

The present description relates to lighting devices.

Various embodiments can relate to lighting devices using LED sources as light radiation sources.

BACKGROUND

The name Zhaga represents a consortium of cooperation between companies of the lighting industry which was set up with the aim of making it easier to interchange solid state lighting sources, for example of the LED type, made by different manufacturers so as to facilitate, for example, general lighting applications.

The International Protection (or IP protection class, a name also interpreted as Ingress Protection) is a code which, in the electrical field, summarizes the level of protection of an apparatus against contact with the human body or with objects and against the penetration of environmental agents.

At present, there are no lighting devices compliant with the Zhaga directives which are also able to offer a certain degree of IP protection. Under these conditions, a Zhaga module cannot be used as a component on its own, that is to say without further protective elements. As a result, when Zhaga modules are used, it may be necessary to also use, in addition to a heat sink normally provided for the mounting of the lighting module, further additional components intended to ensure a degree of IP protection. By way of example, in various solutions, the Zhaga modules may need to be combined with a protective housing, a plastic cover or other components so as to prevent dust, humidity, water and other environmental agents from penetrating into the lighting device, thus damaging the LED module.

SUMMARY

Various embodiments provide lighting devices which can be compliant with the Zhaga directive and at the same time can exhibit a degree of IP protection.

Various embodiments make it possible to provide for one or more of the following advantages:

- compliance with the Zhaga directives in terms of thermal, mechanical and optical characteristics, with simultaneous IP protection;
- applicability inside or outside, including street lighting applications;
- readily available for use in a lighting system without the need to use other components for the IP protection, the protection already being ensured by the device itself;
- applicability of the solution and of the related design models to a large range of dimensions of lighting devices and/or to a large range of shapes;
- the absence of restrictions linked to the selection of a particular shape (for example rectangular), with a broad choice from other shapes, for example round, elliptical, mixed line, etc., retaining conformity with the Zhaga directives.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments.

In the following description, various embodiments described with reference to the following drawings, in which:

FIGS. 2A and 2B, and FIGS. 3 to 6 show various components and assembly phases of embodiments, and FIG. 7 shows one embodiment mounted on a mounting surface.

DETAILED DESCRIPTION

The following detailed description refers to the accompanying drawing that show, by way of illustration, specific details and embodiments in which the disclosure may be practiced In the following description, various specific details aimed at providing a fuller understanding of various exemplary embodiments are explained. The embodiments may be implemented without one or more of the specific details or using other methods, components, materials, etc. In other cases, known structures, materials or operations are not shown or described in detail so that the various aspects of the embodiments may be understood more clearly.

The reference to "an embodiment" in the context of this description indicates that a particular configuration, structure or feature described in relation to the embodiment is included in at least one embodiment. Therefore, phrases such as "in one embodiment", which may occur at various points in this description, do not necessarily refer to the same embodiment. Moreover, particular forms, structures or features may be combined in any suitable manner in one or more embodiments.

The reference signs used here are provided solely for the sake of convenience and therefore do not define the scope of protection or ambit of the embodiments.

In the figures, the reference sign 10 denotes a lighting device intended to be mounted on a mounting surface S, which can be formed, for example, by the surface of a heat sink (not shown as a whole).

The device 10 shown here can be considered to be an example of any kind of lighting device, for example compliant with the Zhaga specifications.

The rectangular shape shown here is therefore to be considered to be purely an example from a wide range of shapes and configurations which the device 10 can adopt. In various embodiments, in addition to being compliant with the Zhaga directives, the device 10 can also exhibit a degree of IP protection.

Figure 1:
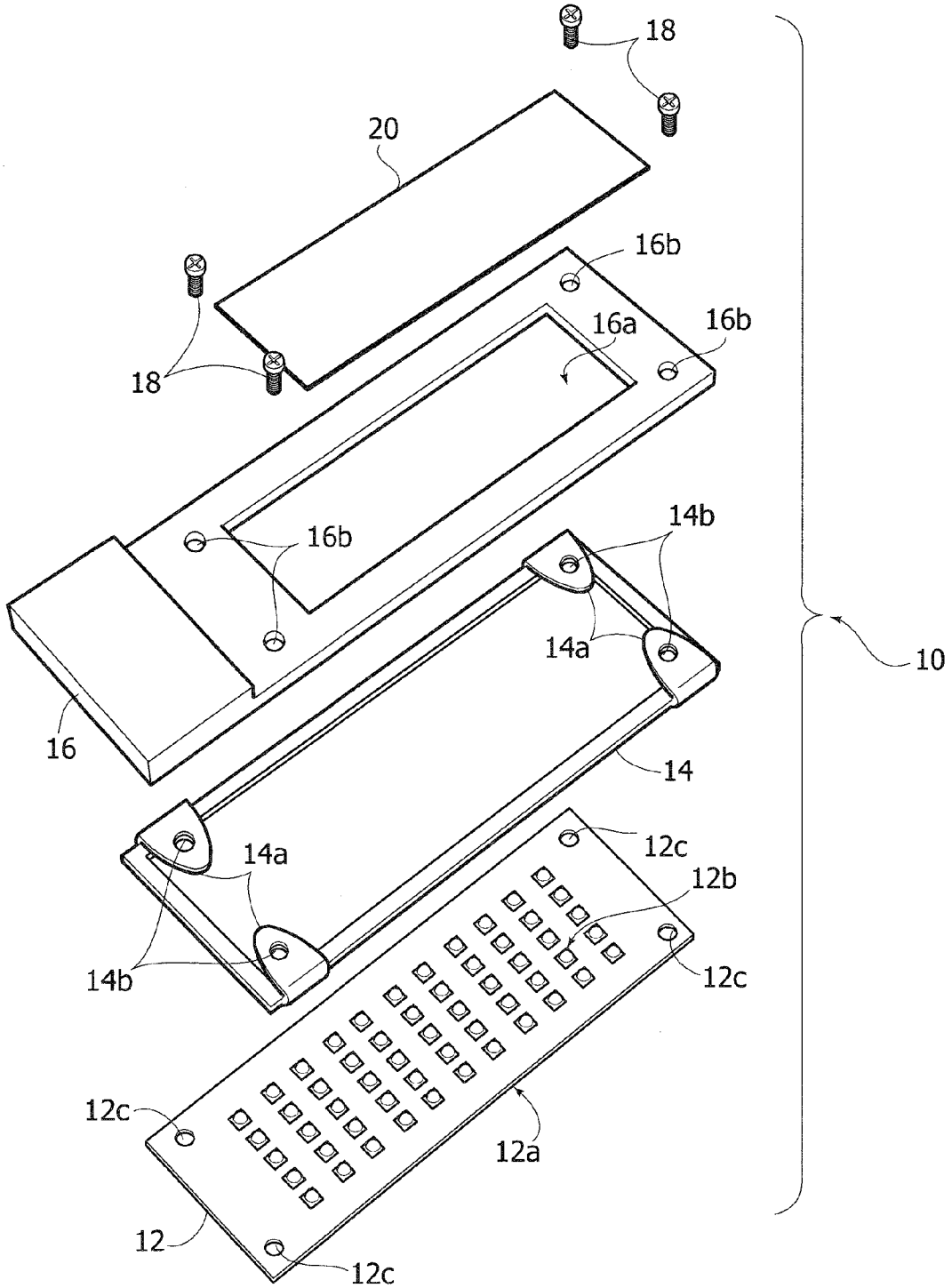
FIG. 1 is an exploded perspective view of one embodiment.

In various embodiments, the device 10 can include, proceeding ideally from bottom to top in the exploded perspective view in FIG. 1:

- a lighting module 12 acting as a light radiation source formed, for example, by a solid state lighting module, for example of the LED type,
- a sealing gasket 14,
- a housing 16,
- means for fixing on a mounting surface S (for example the surface of a heat sink shown in FIGS. 6 and 7), these fixing means can include, for example, screws 18 which can be screwed into corresponding holes (not shown in the drawings) provided in the surface S, moreover ensuring the connection between the various parts 12, 14 and 16, and
- a screen 20 for protecting the region of the module 12 where the light radiation sources are located.

In various embodiments, the module 12 can include a substrate 12*a* (for example formed with a solution equated to a printed circuit board (PCB)) "populated" by one or more light radiation sources, for example organized in an array 12*b* of solid state light radiation sources, for example of the LED type.

In the exemplary embodiment shown, the array 12*b* is ordered with a matrix pattern. In various embodiments, the array 12*b* can have a different distribution, for example a quincuncial distribution.

As already mentioned, the dimensions and the thermal and optical properties of the module 12 can be as desired, for example compliant with the Zhaga standards.

In various embodiments, the module 12 can be provided with a plurality of holes 12*c* for the screws 18 to extend therethrough.

In various embodiments, the holes 12*c* can be positioned peripherally, that is along the perimeter of the module 12.

In various embodiments, the gasket 14 can be made with a flexible material, for example an elastomer such as silicone.

In various embodiments, the gasket 14 can have a profile or form which is modeled on the outline of the module 12 such that it can be applied onto said outline, that is to the periphery of the module 12.

Figure 2A:
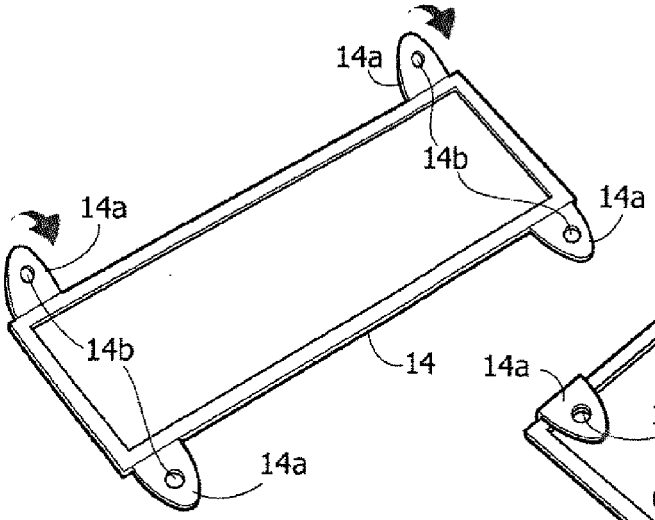

As can be seen more clearly in FIG. 2A, the gasket 14 (which has, in the embodiment shown by way of example here, a rectangular profile matched to the equally rectangular outline of the periphery of the module 12) has ear-like protruding parts 14*a* in positions corresponding to the positions of the holes 12*c* provided in the module 12 (that is, in the examples shown here, at the angular parts of the rectangular shape of the module 12).

The ear-like parts 14*a* have perforations 14*b* (for example made by molding during the formation of the gasket 14 or obtained by piercing the respective ear-like part 14*a* after the formation of the gasket 14).

The flexibility of the material from which the gasket 14 is made ensures that the ear-like parts 14*a* can be turned toward the inside of the outline of the gasket 14 (see the sequence of FIGS. 2A and 2B) so as to align the perforations 14*b* with the holes 12*c* in the module 12 (see for example the bottom part of the exploded perspective view of FIG. 1).

Figure 4:
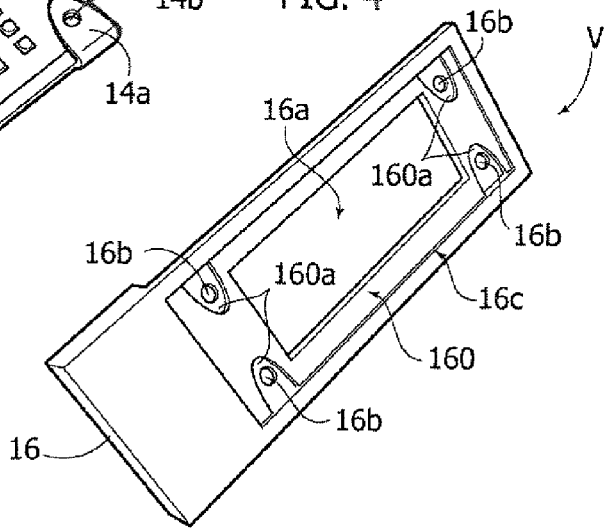

In various embodiments (and as can be seen more clearly by comparing the exploded perspective view of FIG. 1 and the view "from the bottom" of FIG. 4), the housing 16 can have a tray-like general shape so as to ensure that the housing can "frame" the module 12.

In various embodiments, in the bottom part of the tray-like shape, the housing 16 can indeed comprise a window 16*a* intended to extend at the light emitting region, i.e. at the region of the module 12 where the light radiation sources 12*b* are located. All this leaving the region 12*b* uncovered so as to make it possible to project the light radiation produced by the sources 12*b* outwardly of the device 10.

In various embodiments, the housing 16 can include apertures (for example holes) 16*b* intended to extend in alignment with the perforations 14*b* in the gasket 14 and with the holes 12*c* in the module 12. This allows for the passage of the screws 18 intended to fix the device 10 on the mounting surface S and to "hold together" the module 12, the gasket 14 and the housing 16 itself.

In various embodiments, the tray-like shape of the housing 16 has the effect that the inner side of the housing 16, intended to be turned toward the module 12 and the gasket 14, has, along the outline of the window 16*a*, an as a whole "recessed" portion 160, surrounded by a peripheral rim 16*c*: the term "recessed" clearly refers to the viewpoint of FIGS. 4 and 5, where FIG. 5 is a view, shown on an enlarged scale, of the portion of FIG. 4 denoted by the arrow V.

The housing 16 thus constitutes a type of frame which is able to internally receive the module 12 with the interposition of the gasket 14.

Figure 2B:
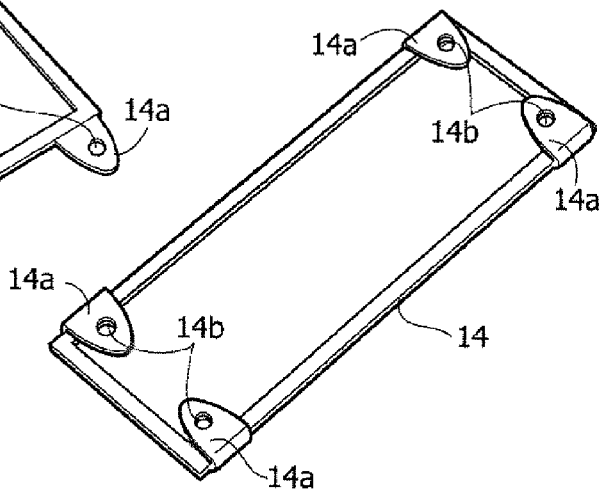
Figure 3:
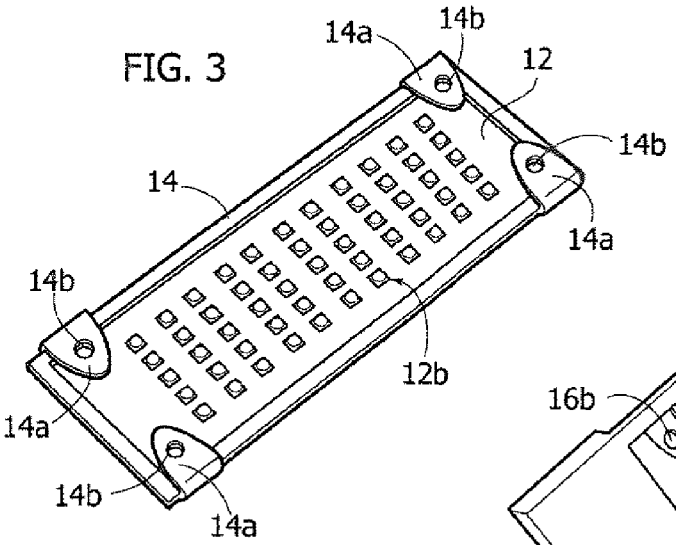

For this purpose, in various embodiments, the recessed portion 160 can have, around the apertures 16*b*, imprints or "indentations" 160*a* which are able to internally receive the ears 14*a* of the gasket 14 that are folded toward the inside of said gasket, as shown schematically in FIG. 2B.

In various embodiments, the housing 16 can therefore be produced in such a way that it simultaneously adapts to the module 12 and to the gasket 14.

In various embodiments, the assembly formed by the module 12, by the gasket 14 and by the housing 16 can be "held together" by the screws 18 which are screwed into the substrate (see FIG. 6) and extend through the apertures 16*b* in the housing 16, the perforations 14*b* in the ear-like extensions 14*a* of the gasket 14 which are folded internally of the gasket 14 and the holes 12*c* in the lighting module 12 so as to retain the gasket 14 sealingly sandwiched between the lighting module 12 and the housing 16.

In various embodiments, once it has been fixed on the surface S using fixing means such as the screws 18, the module 12 can be subjected, by the housing 16, to a uniform pressure such as to ensure:

- on the one hand, that the module 12 adheres to the surface S of the mounting substrate, so as to make it possible to dissipate the heat produced by the sources 12*b*, in particular when the substrate is configured as a heat sink,
- on the other hand, that the external agents cannot penetrate into the device at the interfaces between the module 12 and the gasket 14 and between the gasket 14 and the housing 16.

This also applies at the holes 12*c* and at the apertures 16*b* owing to the presence of the ear-like parts 14*a* of the gasket 14, which act as annular gaskets capable of surrounding the passage through which the screws 18 extend.

Under these conditions, for the main points corresponding to those shown in the bottom part of FIG. 6, the device 10 can satisfy the mechanical, thermal and optical requirements of the Zhaga standards.

In view of the presence of the window 16*a* to make it possible for the light radiation emitted by the sources 12*b* to be projected outwardly of the housing 16, the upper part of the device could remain open, with the light radiation sources 12*b* and the area of the substrate of the module 12 which surrounds them still being exposed to the external agents, with the risk of being damaged.

For this purpose, in various embodiments, the window 16*a* can be covered by the screen 20 made of a generically "light permeable" (that is transparent) material.

In various embodiments, the screen 20 can be made of vitreous material or of plastic.

In various embodiments, the screen 20 can be applied so as to cover the window 16*a* (see FIG. 7) by sticking it peripherally (for example using a silicone-based glue) to the outline of the window 16*a*.

In various embodiments, the screen 20 can be formed in one piece with the housing 16.

In various embodiments, the screen 20 can be made (for example in such a way as not to change the optical features of the system) so as to comply, also with respect to the dimensions, with the Zhaga specifications.

In various embodiments, the screen 20 can be applied to the housing 16 leaving the screws 18 uncovered so as to allow for the possible removal of the device 10 from the substrate S without having to detach the screen 20 from the housing.

Owing to the screen 20, the device 10 once applied to the mounting surface S is protected against the penetration of water, dust or any other external agent both through the side walls and through the upper part.

As a result, in various embodiments, the device 10 can comply with the Zhaga directives and at the same time exhibit IP protection.

The device 10 can therefore be used for the final application without the need for additional components, it being able to be simply fixed on the surface S of the mounting substrate, which can have, for example, heat sink properties.

The device 10 can be used for any lighting application, it being able to be mounted directly inside a lighting device without the need for additional protection (for example a glass or plastic cover).

In various embodiments (also owing to the presence of the gasket 14, which extends around the insertion holes of the screws 18, and owing to the protective action provided by the screen 20), it is therefore possible to prevent any penetration into the device 10 of external agents which are capable of damaging the light radiation sources 12 and the circuits which may be present on the substrate 12*a*, thereby ensuring compliance with the Zhaga specifications.

While the disclosed embodiments has been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device for mounting on a mounting surface, the device comprising:

a planar solid state lighting module having a light emitting region and a plurality of holes for fixing members to the mounting surface to extend therethrough, said holes being arranged at the periphery of the lighting module, a peripheral gasket extending along the periphery of the lighting module, the gasket having, at said holes of the lighting module, ear-like extensions having a perforation therein, said ear-like extensions extending inwardly of the gasket to align the perforations therein with the holes in the lighting module, a housing which frames the lighting device with the gasket applied onto the lighting module, the housing having apertures aligned with the holes in the lighting module and the perforations in the ear-like extensions of the gasket; the housing having a window to expose the light emitting region of the lighting module, and a light permeable screen which sealingly closes the window in the housing, wherein the ear-like extensions are folded inwardly of the gasket over the side of the gasket opposed to the lighting device.

2. A lighting device for mounting on a mounting surface, the device comprising:

a planar solid state lighting module having a light emitting region and a plurality of holes for fixing members to the mounting surface to extend therethrough, said holes being arranged at the periphery of the lighting module, a peripheral gasket extending along the periphery of the lighting module, the gasket having, at said holes of the lighting module, ear-like extensions having a perforation therein, said ear-like extensions extending inwardly of the gasket to align the perforations therein with the holes in the lighting module, a housing which frames the lighting device with the gasket applied onto the lighting module, the housing having apertures aligned with the holes in the lighting module and the perforations in the ear-like extensions of the gasket; the housing having a window to expose the light emitting region of the lighting module, and a light permeable screen which sealingly closes the window in the housing, wherein the housing has, on the side facing the lighting module and the gasket, a recessed portion surrounding said window, the recessed portion having imprints therein to receive the ear-like extensions of the gasket.

3. The device as claimed in claim 1, wherein the housing has, on the side facing the lighting module and the gasket, a peripheral wall to surround the gasket extending along the periphery of the lighting module.

4. The device as claimed in claim 1, including fixing members extending through:

the apertures in the housing, the perforations in the ear-like extensions of the gasket, and the holes in the lighting module to retain the gasket sealingly sandwiched between the lighting module and the housing.

5. The device as claimed in claim 1, wherein said light-permeable screen leaves said apertures in the housing uncovered.

6. The device as claimed in claim 1, wherein the lighting module is an LED module.

7. The device as claimed in claim 4, the fixing members are screws.

* * * * *